US005993193A

United States Patent [19]

Loftus et al.

[11] Patent Number: 5,993,193

[45] Date of Patent: Nov. 30, 1999

[54] VARIABLE HEAT FLUX LOW EMISSIONS BURNER

[75] Inventors: Peter J. Loftus, Cambridge, Mass.; Charles E. Benson, Windham, N.H.; Roberto O. Pellizzari, Groton, Mass.; Richard R. Martin, Tulsa, Okla.

[73] Assignee: Gas Research, Inc., Chicago, Ill.

[21] Appl. No.: 09/020,362

[22] Filed: Feb. 9, 1998

[51] Int. Cl.[6] ..... F23C 5/00

[52] U.S. Cl. ..... 431/8; 431/12; 431/174; 431/285; 239/562; 239/551

[58] Field of Search ..... 431/8, 9, 116, 431/115, 350, 181, 187, 278, 174, 284, 285, 12; 239/548, 549, 550, 551, 407, 416.5

[56] References Cited

U.S. PATENT DOCUMENTS

| | | | |
|---|---|---|---|
| 1,808,120 | 7/1931 | Runkwitz | 431/284 |
| 2,779,399 | 1/1957 | Zink et al. | 158/115 |
| 2,823,628 | 1/1958 | Poole et al. | 110/28 |
| 2,973,032 | 2/1961 | Reilly et al. | 158/11 |
| 3,115,924 | 12/1963 | Massier | 158/73 |
| 3,163,203 | 12/1964 | Ihlenfield | 158/11 |
| 3,180,395 | 4/1965 | Reed | 158/11 |
| 3,217,779 | 11/1965 | Reed et al. | 158/11 |
| 3,589,845 | 6/1971 | Morse | 431/10 |
| 3,709,654 | 1/1973 | Desty et al. | 431/284 |
| 3,748,111 | 7/1973 | Klose | 48/192 |
| 3,999,936 | 12/1976 | Hasselmann | 431/202 |
| 4,003,692 | 1/1977 | Moore | 431/158 |
| 4,105,393 | 8/1978 | Boylett | 431/116 |
| 4,175,920 | 11/1979 | Guerre et al. | 431/175 |
| 4,224,019 | 9/1980 | Dilmore | 431/328 |
| 4,257,762 | 3/1981 | Zink et al. | 431/177 |
| 4,347,052 | 8/1982 | Reed et al. | 431/188 |
| 4,428,727 | 1/1984 | Deussner et al. | 431/182 |
| 4,474,120 | 10/1984 | Adrian et al. | 110/261 |
| 4,610,625 | 9/1986 | Bunn | 431/284 |
| 4,626,195 | 12/1986 | Sato et al. | 431/188 |
| 4,629,413 | 12/1986 | Michelson et al. | 431/9 |
| 4,640,678 | 2/1987 | Fraioli | 431/12 |
| 4,793,798 | 12/1988 | Sabin | 239/562 |
| 4,815,966 | 3/1989 | Janssen | 431/174 |
| 4,925,387 | 5/1990 | Locanetto et al. | 431/187 |
| 5,039,300 | 8/1991 | Riehl | 431/354 |
| 5,049,066 | 9/1991 | Kaiya et al. | 431/352 |
| 5,062,792 | 11/1991 | Maghon | 431/284 |
| 5,073,105 | 12/1991 | Martin et al. | 431/116 |
| 5,098,282 | 3/1992 | Schwartz et al. | 431/9 |
| 5,154,596 | 10/1992 | Schwartz et al. | 431/181 |
| 5,195,884 | 3/1993 | Schwartz et al. | 431/8 |
| 5,240,410 | 8/1993 | Yang et al. | 431/284 |
| 5,284,438 | 2/1994 | McGill et al. | 431/9 |
| 5,310,337 | 5/1994 | Lifshits et al. | 431/174 |
| 5,328,357 | 7/1994 | Riehl | 431/266 |
| 5,342,192 | 8/1994 | Hirano | 431/284 |
| 5,441,403 | 8/1995 | Tanaka et al. | 431/284 |
| 5,458,481 | 10/1995 | Surbey et al. | 431/115 |
| 5,511,970 | 4/1996 | Irwin et al. | 431/9 |
| 5,636,977 | 6/1997 | Benson et al. | 431/8 |

FOREIGN PATENT DOCUMENTS

| | | | |
|---|---|---|---|
| 81749 | 12/1976 | Australia | 23/11 |

*Primary Examiner*—Ira S. Lazarus
*Assistant Examiner*—Josiah C Cocks
*Attorney, Agent, or Firm*—Factor and Shaftal

[57] ABSTRACT

A gas fired burner is provided for use in applications such as chemical process furnaces for process heaters in refineries and chemical plants, and the like. The burner is provided with a plurality of fuel gas inlets for enabling manipulation of the flame shape and combustion characteristics of the burner, based upon variation in the distribution of fuel gas between the various fuel gas inlets.

A combination pilot and flame holder for a burner, such as may be used in process heaters and furnaces for refineries, chemical plants and the like, is also provided. The pilot is mounted atop a supply pipe for premixed fuel and air, which is positioned in the bore of a burner quarl. The pilot includes a radially outwardly extending flange which is upstream of a surface combustion flame holder for establishing a radially directed surface combustion flame.

The present invention also provides a low-emissions burner and pilot system for use in such process heaters and furnaces.

14 Claims, 13 Drawing Sheets

Secondary Fuel Injector Angle

◆ 6 injectors at 18 deg

◇ 3 inj. at 18 deg, 3 inj. at 36 deg

Natural Gas
15% Excess Air
Furnace Exit Temp=1700F at Full Fire

VARIABLE HEAT FLUX LOW EMISSIONS BURNER

BACKGROUND OF THE INVENTION

1. The Technical Field

The present invention relates to gas fired burners, of the type which may be used in industrial furnaces and the like, and specifically to burners of the partially premixed type.

2. The Prior Art

Burners which are used in chemical and manufacturing processes often suffer from the problem of matching the heat flux produced by the burner and placed into the space to be heated in the furnace or heat exchanger to the actual load required in order to maximize the amount of heat flux which is being efficiently used, to further maximize the actual rate of production or rate of the process and to reduce problems such as coking, in process heaters for refineries, for example.

Such burners, may also occasionally suffer from operational drawbacks, such as instability of the flame relative to the flame holder, which may be evidenced in terms of lift off of the flame from the burner tile, or flame noise and pulsation. In addition, such burners may often produce undesirable levels of emissions, particularly oxides of nitrogen.

Many conventional gas-fired burners use a diffusion flame combustion process in which combustion occurs over a range of equivalence ratios, including high temperature, lean regions where thermal nitrogen oxides ($NO_x$) form. One known method for reducing peak flame temperatures is to use a combustion process which creates a fuel-rich primary combustion region and subsequent air staging with corresponding heat loss, resulting in lowering the overall combustion equivalence ratio to achieve complete combustion.

Another known method for reducing peak flame temperatures relates to a combustion process that operates with a fuel-lean primary combustion region and fuel staging in order to raise the equivalence ratio. However, such known methods of stages fuel combustion rely upon a diffusion flame to produce the lean primary stage. External flue gas recirculation has been added to such known methods for further reducing $NO_x$.

In the combustion of gaseous fuels, $NO_x$ is formed primarily through fixation of molecular nitrogen and oxygen in the combustion air. It is known that thermal $NO_x$ formation depends on the existence of flame regions with relatively high temperatures and excess oxygen. Many conventional combustion methods for reducing $NO_x$ are based upon avoiding such conditions.

It is necessary to consider the prompt $NO_x$ formation process in order to reach very low $NO_x$ levels. Reactions between hydrocarbon fragments and molecular nitrogen can lead to the formation of bound nitrogen species, such as hydrogen cyanide (HCN), which can subsequently be oxidized to nitrogen monoxide. Such processes become significant relative to the thermal mechanism under moderately fuelrich conditions at relatively low temperatures. Avoiding such conditions can reduce prompt $NO_x$ contributions.

Additionally, these prior art burners often employ pilot flames for establishing the primary flame region over the burner in a furnace. The pilot, even though small in heat release may substantially contribute to overall burner emissions, particularly of oxides of nitrogen, under ultra low $NO_x$ operation.

An object of the present invention is to provide a burner which has greatly reduced emissions, particularly of oxides of nitrogen.

Another object of the invention is to provide a burner system which is capable of enabling active management and variation of the heat flux in order to allow for the optimization of the heating process and modify the heat flux of the burner to avoid process shutdowns, while maximizing furnace availability.

A further object of the invention is to provide a pilot for a burner, such as may be used in chemical plant process heaters and the like, which provides the establishment of the primary flame region while contributing less to the heat released by the burner and contributing less to the emissions produced by the burner, particularly oxides of nitrogen.

Still another object of the invention is to provide a gaseous fuel burner system which provides a well organized flame with no significant regions of lean high temperature conditions, which are known to contribute to increased $NO_x$ emissions.

These and other objects of the invention will become apparent in light of the present specification, including claims, and drawings.

SUMMARY OF THE INVENTION

The present invention is directed to a burner apparatus for burning gaseous fuel, of the type configured for use in industrial heaters, furnaces, boilers and the like.

The burner apparatus comprises, in part, a burner quarl, disposed in a wall, floor or roof of an enclosure, the interior space of which is to be heated. The burner quarl has an axis and a bore extending through it. A stream of mixed air and gaseous fuel is supplied through the bore of the burner quarl, substantially parallel to the axis of the burner quarl. A stream of combustion air, substantially unmixed with gaseous fuel, is also directed into the bore of the burner quarl.

A first stream of gaseous fuel is directed into the bore of the burner quarl, and a second stream of gaseous fuel is directed into a combustion region disposed downstream of the burner quarl. Means for supplying a stream of mixed air and gaseous fuel, means for supplying a first stream of gaseous fuel, and means for supplying a second stream of gaseous fuel are all cooperatively associated with one another, to enable the relative proportions of gaseous fuel being supplied to the means for supplying a stream of mixed air and gaseous fuel, the means for supplying a first stream of gaseous fuel, and means for supplying a second stream of gaseous fuel to be selectively varied, in order to vary the pattern of heat flux being produced when the burner apparatus is in operation.

The burner apparatus also comprises means for directing flue gases in the enclosure into the bore of the burner quarl. The means for directing flue gases include at least one passage in the burner quarl, extending from an exterior surface of the burner quarl to the bore of the burner quarl.

The means for supplying a first stream of gaseous fuel into the bore of the burner quarl may include at least one fuel nozzle disposed in the at least one passage, The means for supplying a second stream of gaseous fuel into a combustion region disposed downstream of the burner quarl further comprises at least one fuel nozzle disposed at a position on the periphery of the burner quarl. The at least one fuel nozzle may be disposed to aim a jet of fuel gas toward the axis of the burner quark, The means for supplying a stream of mixed air and gaseous fuel through the bore of the burner quarl further comprises, in part, a tube, having a first end extending into the bore of the burner quarl, and having a second end disposed at a position remote from the bore of the burner quarl. In addition, a source of gaseous fuel is disposed to inject a stream of gaseous fuel into the second end of the tube. A source of combustion air is associated with the tube to enable combustion air to be entrained into the stream of gaseous fuel being injected into the second end of the tube.

The means for supplying a stream of combustion air, substantially unmixed with gaseous fuel, into the bore of the burner quarl, may be a burner housing associated with the burner quarl and positioned substantially exterior to the wall, floor or roof of the enclosure, and opening onto the bore of the burner housing. The burner housing substantially surrounds the second end of the tube. The burner housing is connected to the source of combustion air, so that at least a portion of combustion air passes along an outside surface of the tube, from the second end of the tube to the first end of the tube and into the bore of the burner quarl.

The present invention also comprises a method for operating a burner apparatus.

BEST MODE FOR CARRYING OUT THE INVENTION

Figure 2:
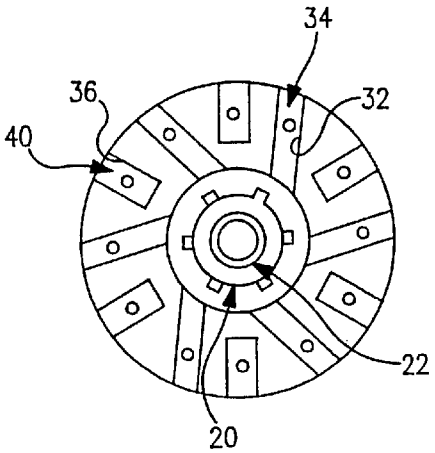
FIG. 2 is a top plan view of the burner quarl and flame holder/pilot for the burner

While this invention is susceptible of embodiment in many different forms, there is shown in the drawings and will be described herein in detail, a specific embodiment with the understanding that the present disclosure is to be considered an exemplification of the principles of the invention and is not intended to limit the invention to the embodiment illustrated.

While the embodiments of the invention discussed herein are shown in the environment of a floor of a furnace, it is to be understood that the burners of the present invention may also be installed in a side wall or roof of a furnace, with suitable modifications which would be readily apparent to one of ordinary skill in the art having the present disclosure before them, without departing from the principles of the invention. In addition, although the furnaces of the present invention are discussed with respect to natural ("thermal") draft furnaces, it is to be understood that powered burners and/or induced draft burners are also intended to be encompassed by the principles of the invention described herein, with suitable modifications which would be readily apparent to one of ordinary skill in the art having the present disclosure before them.

Figure 1:
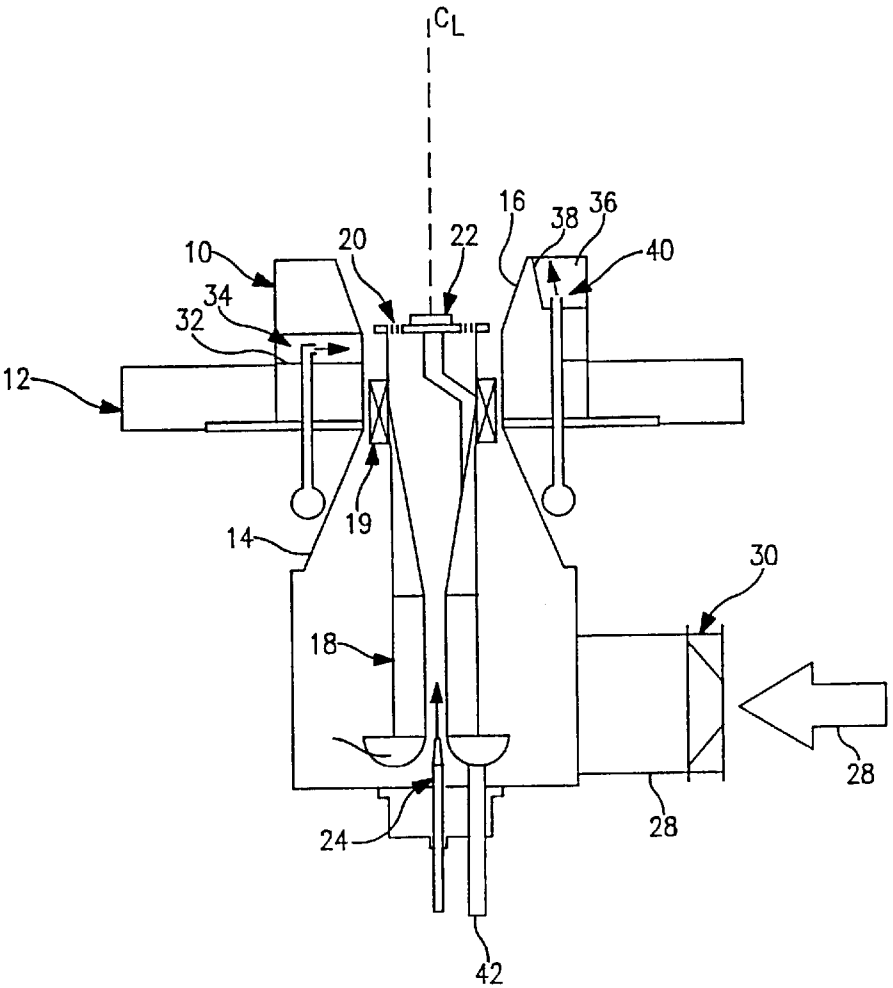
FIG. 1 is a schematic illustration, in section, of the variable heat flux low emissions burner, in accordance with one embodiment of the present invention.

FIGS. 1 and 2 illustrate schematically a variable heat flux low emissions burner according to a preferred embodiment of the invention. The burner is substantially symmetrical about a central axis $C_L$ and includes a burner quarl 10 (also "burner block") which is fixably mounted into a furnace floor 12. A burner housing 14 is situated external (e.g., below) the furnace floor. The burner quarl 10 is a substantially cylindrical structure having a central axially extending bore 16. A venturi tube 18 extends from the burner housing into bore 16 and is capped by flame holder 20, which includes pilot 22.

A fuel tip 24 projects into inlet 26 of venturi tube 18 for enabling injection of gaseous fuel. Air duct 28 connects to burner housing 14 for permitting the introduction of combustion air into burner housing 14. A portion of the air inletted from duct 28 is entrained in the fuel gas jet from fuel tip 24, and the remaining air inletted from duct 28 surrounds venturi tube 18 and flows upwardly. The combustion air flow through duct 28 is induced into the burner by the thermal draft generated within the furnace. The air flow is regulated by damper 30.

Inside the burner housing 14, the air flow is divided into two streams: the premix air passes through venturi tube 18, while the secondary air passes through an annulus around venturi tube 18. The proportional split of the air flow is determined by the geometry and size of the venturi tube 18 and annulus and the height of the venturi tube inlet above the burner housing floor.

The proportion of the total air that flows through the venturi tube and the proportion of the total fuel that flows through the venturi tube are adjusted so as to generate a combustible, lean fuel-air mixture at the exit of the venturi tube. In a preferred configuration, approximately 15–20% by volume of the total air flow passes through the venturi. Vanes 19 may be provided to support venturi tube 18 and keep it centered in bore 16. In addition, vanes 19 may be pitched at an angle, to impart a swirling motion to the rising combustion air.

Burner quarl 10 is provided with a plurality of substantially horizontally extending passages 32 which extend from an exterior surface of burner quarl 10 completely through to bore 16. Preferably, each passage 32 is oriented relative to the axis of burner quarl 10 so that the direction of flow which would be enabled through each passage 32 is substantially tangential to flame holder 20 upon entry into bore 16. Alternatively, passages 32 may be arranged to be radial to central axis $C_L$. A primary fuel tip 34 is positioned inside each passage 32 and is connected to a source of gaseous fuel.

A plurality of notches 36 are provided in the upper, outer surface of burner quarl 10. Each notch 36 extends from a position on the radially outer surface of burner quarl 10 to a position within burner quarl 10, but not extending completely to bore 16. The inner face 38 of each notch 36 is preferably angled radially inward and upward for facilitating the directing of flow radially inward from the notch. A secondary fuel tip 40 is provided in each notch 36 and is likewise connected to a source of gaseous fuel.

Preferably, the flow rates of gaseous fuel provided to fuel tip 24, primary fuel tips 34 and secondary fuel tips 40 are independently controllable so that for a given total flow rate of fuel to the burner, the proportions of the fuel flow directed to 1) tip 24; 2) tips 34 (as a group); and 3) tips 40 (as a group), may be selectively varied.

As previously stated, the single fuel tip 24 is preferably located coaxial to the vertical axis $C_L$ of burner quarl 10 and is positioned close to the inlet end 26 of venturi tube 18. The fuel jet exiting fuel tip 24 entrains some air into venturi tube 18 to form an extremely lean mixture of fuel gas and air which is ignited and stabilized by the pilot 22 (in a matter to be described hereinafter) to form a primary combustion region.

Primary fuel tips 34 are located within passages 32 in burner quarl 10. Primary fuel jets emitted by primary fuel tips 34 are directed substantially radially inwardly through passages 32, perpendicular to the direction of air flow inside the burner quarl 10. Passages 32 in burner quarl 10 enable furnace gases to be entrained by the primary fuel jets and introduced into the flame region. Passages 32, as previously described, are preferably angled relative to the central axis $C_L$ of burner quarl 10 to produce a swirling flow in the flame region.

Burner quarl 10, as previously stated, also includes notches 36 for receiving secondary fuel tips 40 distributed at uniformly dispersed angular positions around central axis $C_L$. Due to the inclination (at an angle of 15° to 30°) of the gas jets and the inner face 38 of each notch 36, the secondary fuel tips 40 produce secondary fuel jets which are inclined toward the center of the burner at a small angle (preferably in the range of 10° to 20°). The secondary fuel jets also entrain furnace gases from outside the burner quarl 10 and mix them into the flame region.

In a preferred normal operation, fuel exiting fuel tip 24 will account for 10% to 15% by volume of total fuel flow into the burner. By appropriate adjustment of the distribution of remaining fuel between primary and secondary fuel tips 34, 40, the degree of swirl, the amount of flue gas entrainment into the primary flame, the flame shape, and the furnace heat flux profile can be widely varied.

Figure 2A:
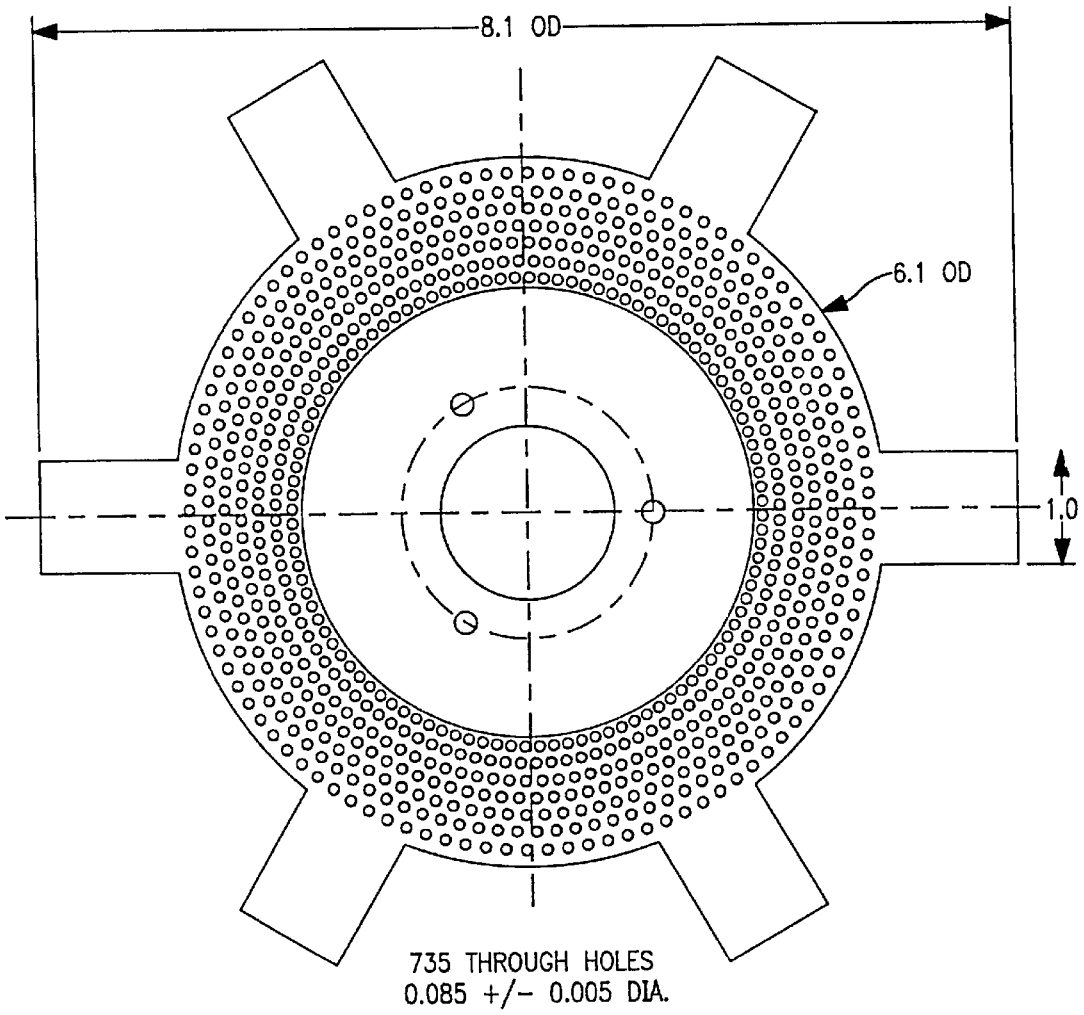
FIG. 2*a* illustrates a possible arrangement for the premix flame holder plate, above which the pilot burner may be positioned.

FIG. 2*a* illustrates a possible arrangement for the premix flame holder plate, above which the pilot burner may be positioned. The shape and configuration of the premix burner plate may be modified by one of ordinary skill in the art, having the present disclosure before them, depending upon the requirements of a particular application.

The control method or algorithm for determining how and when to vary the fuel splits will typically be application and process-dependent, and can be readily arrived at by one of ordinary skill in the art, having the present disclosure before them. For optimum emissions performance, the proportion of fuel exiting the primary tips will be in the range of 30%–40% by volume of the total fuel and the proportion of fuel exiting the secondary tips will be in the range of 50%–60% by volume of the total fuel.

Figure 3:
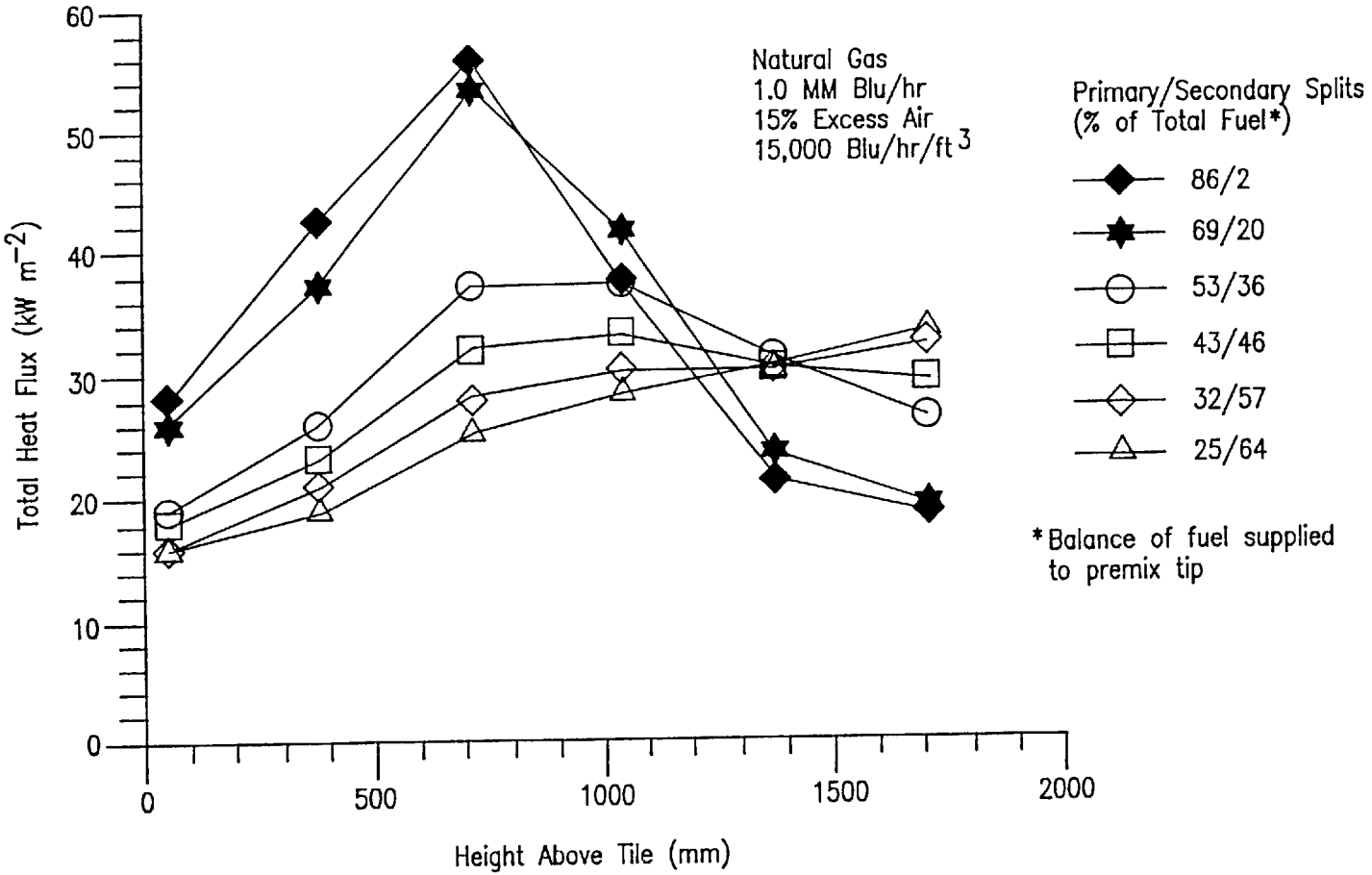
FIG. 3 is a plot of the effect of primary/secondary fuel split on heat flux in a furnace having a burner as illustrated in FIGS. 1 and 2.

FIG. 3 illustrates representative heat flux data for the operation of a burner according to the embodiment of FIGS. 1 and 2, in which the furnace is oriented vertically with the burner mounted at the bottom of the furnace. As the fuel distribution is shifted from the primary fuel tips 34 to the secondary fuel tips 40, the heat flux profile changes from a "peaky" profile with the maximum heat flux physically close to the burner, to a substantially smooth heat flux profile with the heat flux increasing with height above the burner quarl 10.

This ability to change the furnace heat flux profile while the furnace is on line by way of selecting varying means 91, by varying the distribution of fuel between primary fuel tips 34 and secondary fuel tips 40 can allow the optimization of the performance of a process heater equipped with such burners. Existing sensors and data such as tube wall temperatures, process loop pressure drops and flowrates, inlet and outlet temperatures, and stack oxygen analysis, etc., can be used to optimize the productivity of the heater. For example, detection of locally highest tube temperatures by means of thermocouple measurements could indicate onset of coking within the process tube at that location. Adjusting the burner fuel splits will then allow reduction of heat flux at that location, reducing coke formation and permitting continued operation of the heater.

As shown in FIGS. 1 and 2, pilot 22 together with flame holder 20, are positioned at the uppermost end of venturi tube 18. A separate pilot gas/air tube 42 extends upward partially within the wall of venturi tube 18 up to the underside of flame holder 20 to provide fuel gas and combustion air for pilot 22.

Figure 4:
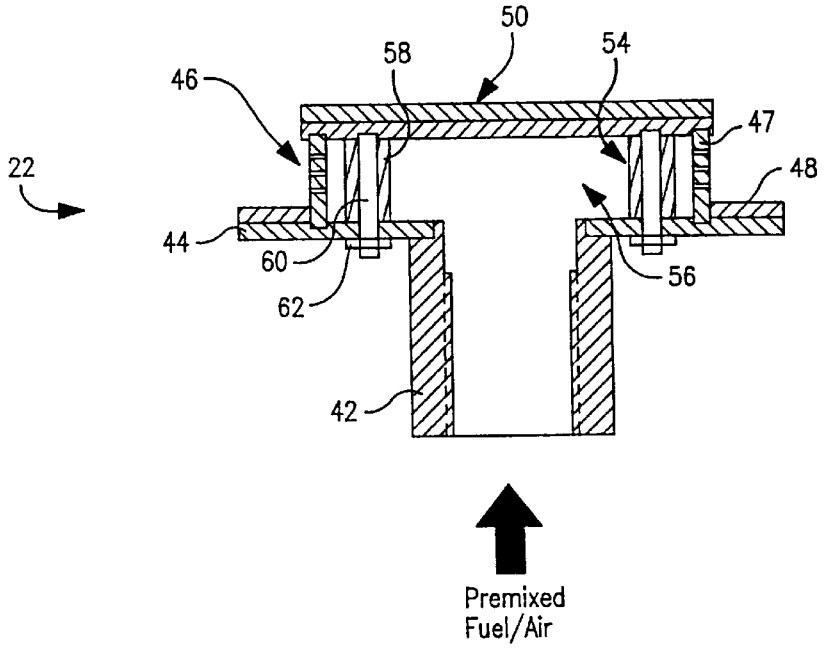
FIG. 4 is a side elevation, in section, of a low-emissions surface combustion pilot and flame holder, according to the principles of the present invention.

FIG. 4 illustrates a preferred configuration for pilot 22. Flame holder 20 has been omitted from FIG. 4 for purposes of simplification of the illustration. Flange 44, is positioned atop pilot pipe 42. Surface combustion flame holder 46 is a short cylindrical structure centered on flange 44 and held in place by annular flange 48 and affixed atop flange 44, such as by welding, brazing, etc. Surface combustion flame holder 46 may be formed as a compressed metal fiber cylindrical member, or it may be a solid metal sheet which has been provided with a plurality of perforations which extend radially through the sheet.

Flame holder 46 is topped by a disc 47, and at least one layer of insulating material in the form of a disc 50. Discs 47 and 50 prevent direct axial flow of the fuel and air from pipe 42 and instead direct the flow of the fuel and air radially outward through flame holder 46. A flame arrestor (not shown) may be positioned at the end of pipe 42, in the form of a cylindrical plug having a plurality of very narrow perforations extending therethrough, to prevent flashback of flame down pipe 42 to the source of the combustion fuel and air.

In order to limit the clamping pressure placed upon flame holder 46 during assembly of pilot 22, a plurality of standoffs 54 are provided and positioned within pilot plenum 56. Each standoff comprises a cylindrical bushing 58. Insulation disc(s) 50 are clamped to flange 44 by bolts 60 and nuts 62.

Bolts 60 pass through bushings 58. Accordingly, standoffs 54, which are preferably uniformly radially positioned around the inner periphery of flame holder 46 will bear the majority of the clamping force used to hold pilot 22 together.

Figure 4A:
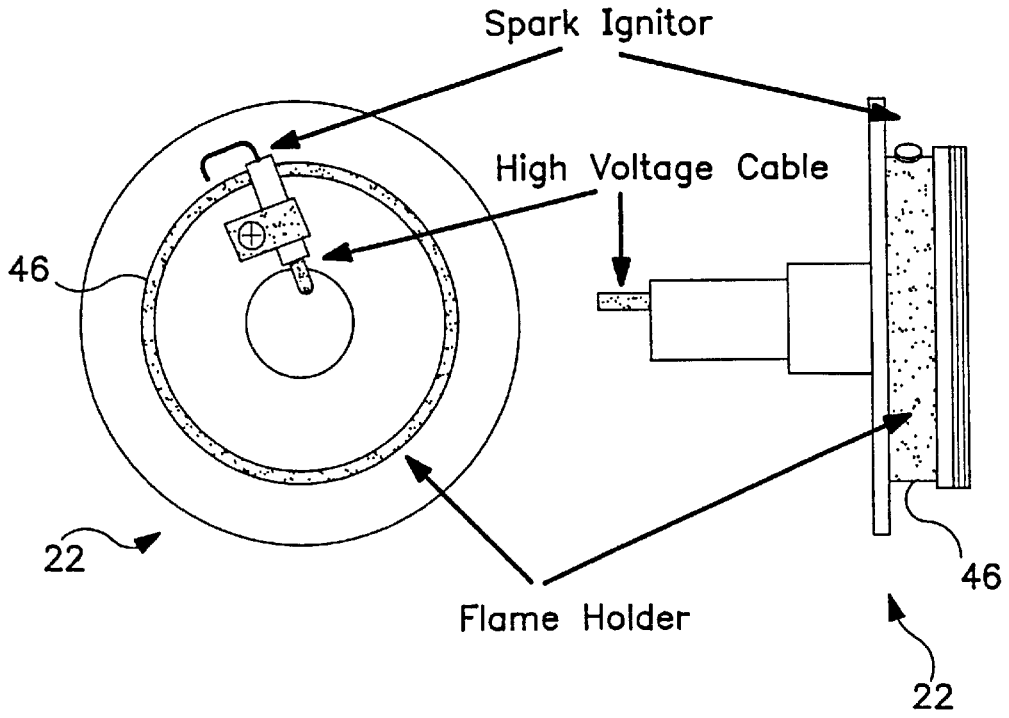
FIG. 4*a* shows bottom and side schematic illustrations of the pilot, showing the placement of the igniter elements.

FIG. 4*a* shows bottom and side schematic illustrations of the pilot, showing the placement of the igniter elements. For example, a high voltage wire may extend upward alongside or inside pipe 42 to pilot 22. The high voltage wire may then be connected to a spark ignitor mounted on the pilot flame holder 46, to create a spark to ignite the pilot flame. The spark ignitor may also serve to act as a flame detection rod once the pilot has been lit.

The configuration of pilot 22 is such that external flow passing around pilot 22 along its vertical axis will generate an extremely stable recirculation region downstream of the radially extending overhang of the flange 44 and 48 and adjacent to flame holder 46 itself.

Figure 5:
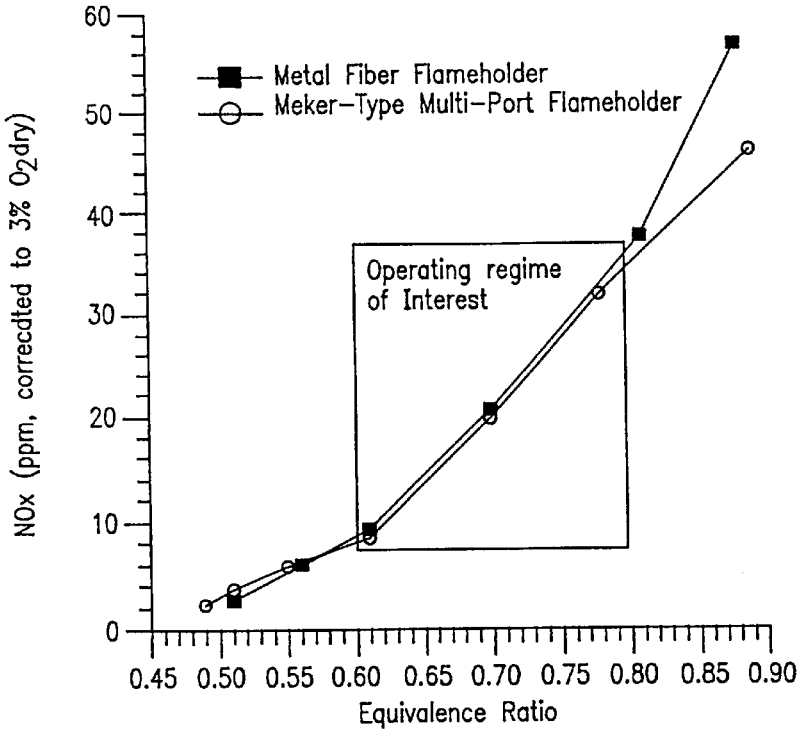
FIG. 5 is a plot of emissions performance data for a surface combustion pilot and flame holder, in two configurations, in accordance with the principles of the present invention.

FIG. 5 illustrates emission data for both types of surface combustion flame holder 46 which have been described. In the operating regime of interest, the pilot $NO_x$ emissions are between 20 and 30 ppmV (parts per million—volume basis) (corrected to 3% $O_2$, dry). Surface combustion flame holders of both the perforated sheet and metal fiber types have been shown to have stable combustion characteristics over a relatively broad range of equivalence ratios, with substantially reduced $NO_x$, emissions compared to prior art pilot arrangements.

Figure 6:
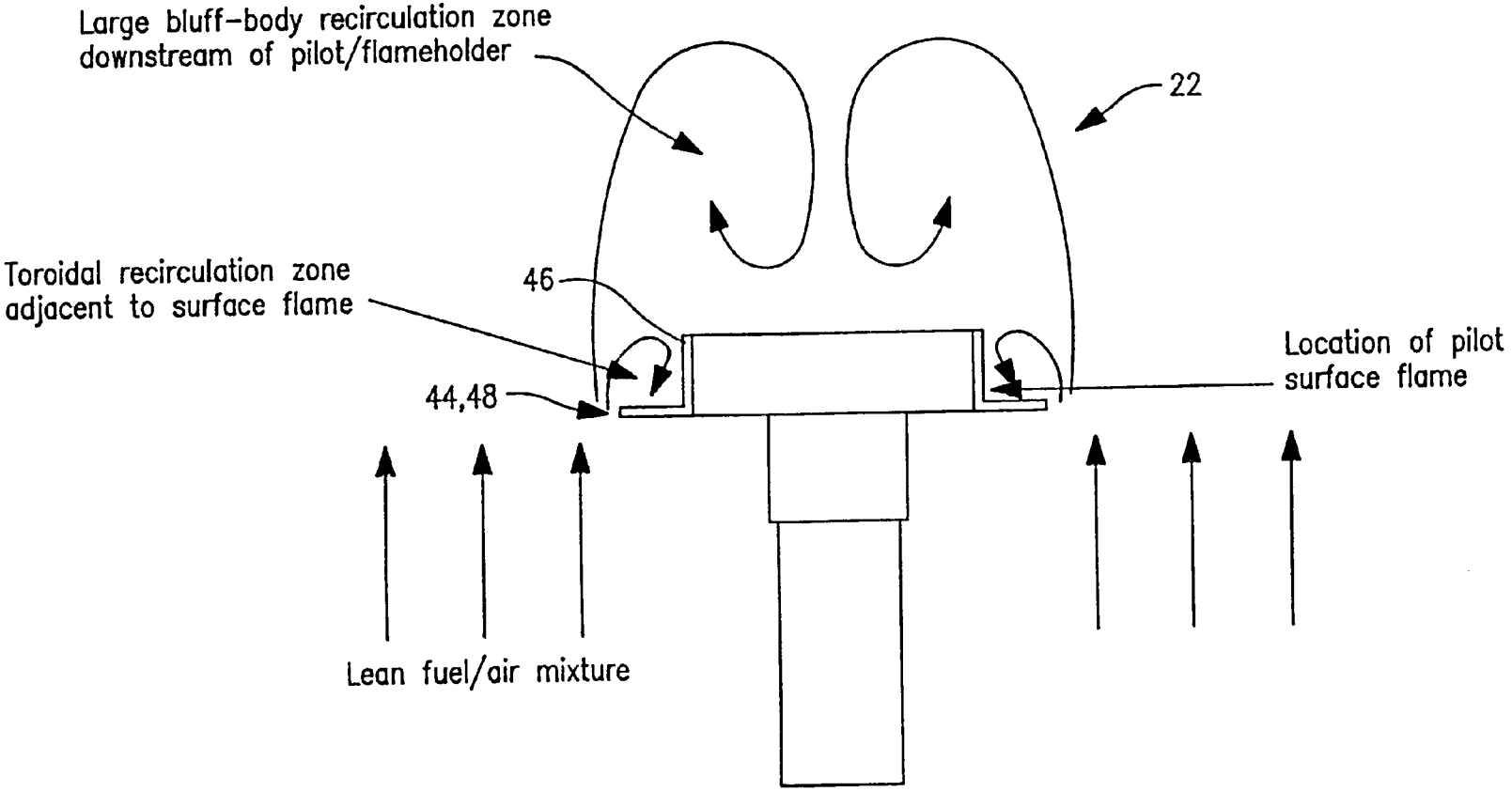
FIG. 6 is a schematic diagram illustrating interaction of main burner flow and the surface pilot flame, of a surface combustion pilot and flame holder, according to the principles of the present invention.

FIG. 6 indicates general flow patterns around pilot 22, indicating recirculation regions which are generated and which provide a high degree of flame stability for lean gas air mixtures. A small toroidal recirculation region is generated downstream of the radially extending flanges 44 and 48 and adjacent to the surface combustion flame on the surface of flame holder 46. The lean mixture entering this recirculation region is ignited by the surface flame and then allows the flame to propagate outward to the main circulation region. A large bluff-body type recirculation region is generated downstream of the pilot/flame-holder assembly. These flow field interactions enable this pilot configuration to stably ignite and maintain extremely lean and/or flue-gas containing (and hence extremely low emissions) main burner flames.

Preferably, the amount of fuel which is fed to pilot 22 will be in amounts in the range of 0.5%–2.0% by volume of the total fuel gas fed to the burner. Thus, pilot contribution to overall $NO_x$ emissions will be negligible.

Figure 7:
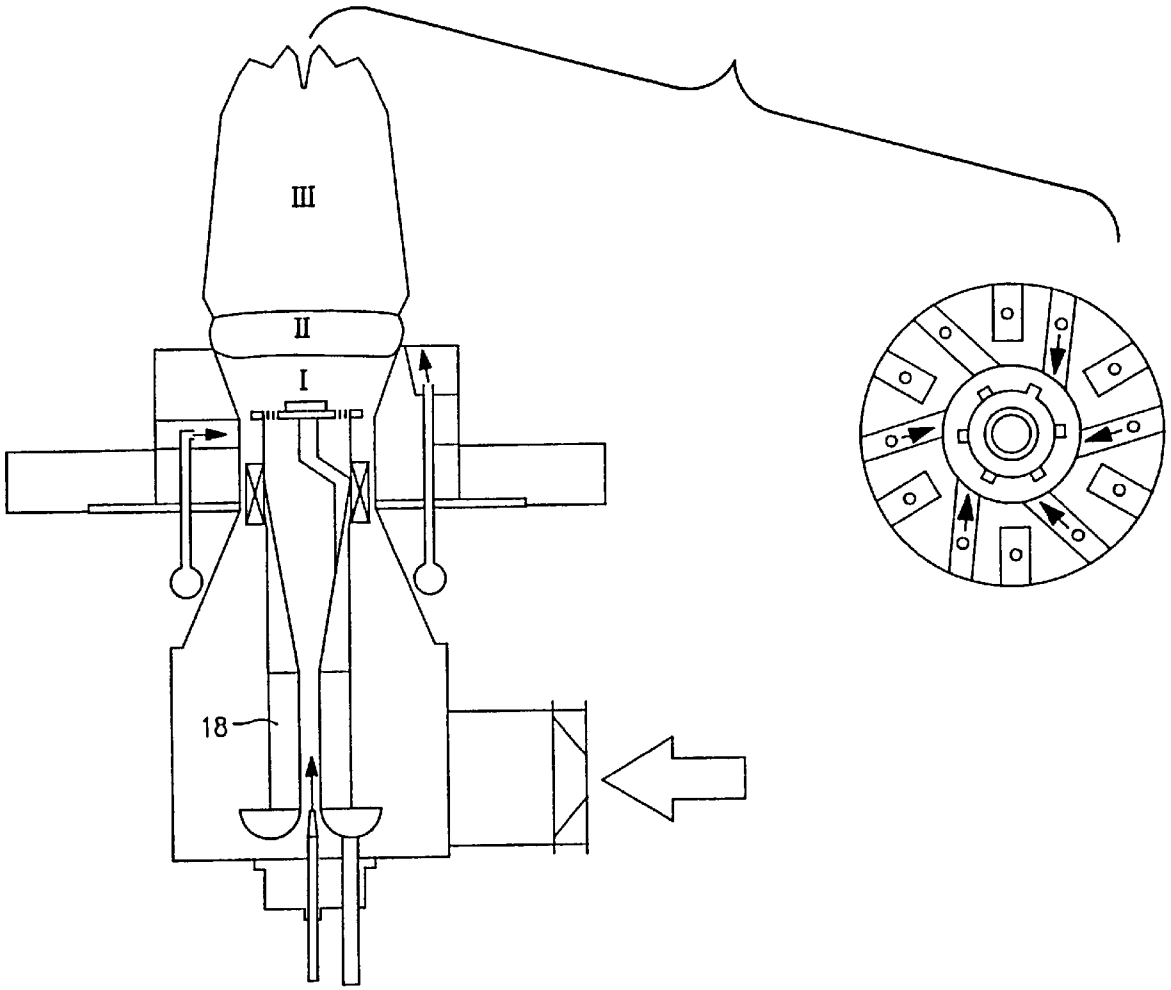
FIG. 7 is a schematic diagram of a flame structure for a burner/pilot system according to the principles of the present invention.

FIG. 7 illustrates the combustion process for the burner and pilot configurations of the present invention. A three stage combustion approach is established. A low emissions primary flame region (I) is created by burning a lean fuel/air mixture on the flame holder. The lean mixture is prepared via the venturi tube 18. The pilot flame, which typically, will be kept burning even once the main burner flame has been ignited, also resides in the primary flame region.

A low-emissions secondary flame region (II) is created by igniting a substantially uniform mixture of fuel, air and flue-gas which is swirling around the primary leanpremixed flame. The fuel/flue-gas mixture is generated by injecting fuel inward in passages which pass through the burner quarl, thereby entraining flue gases. This fuel/flue-gas mixture mixes with air passing around the lean premix venturi tube 18 before being ignited.

A low-emissions tertiary flame region (III) is created by igniting a substantially uniform mixture of fuel and flue-gas which is injected into the secondary flame envelope. This mixture is prepared by injecting secondary fuel at such an angle as to permit significant entrainment of flue-gas before the mixture is ignited.

In this manner, an extremely uniform and well-organized flame is produced, with no significant regions of lean high temperature conditions. The $NO_x$ emissions are therefore extremely low.

Figure 8:
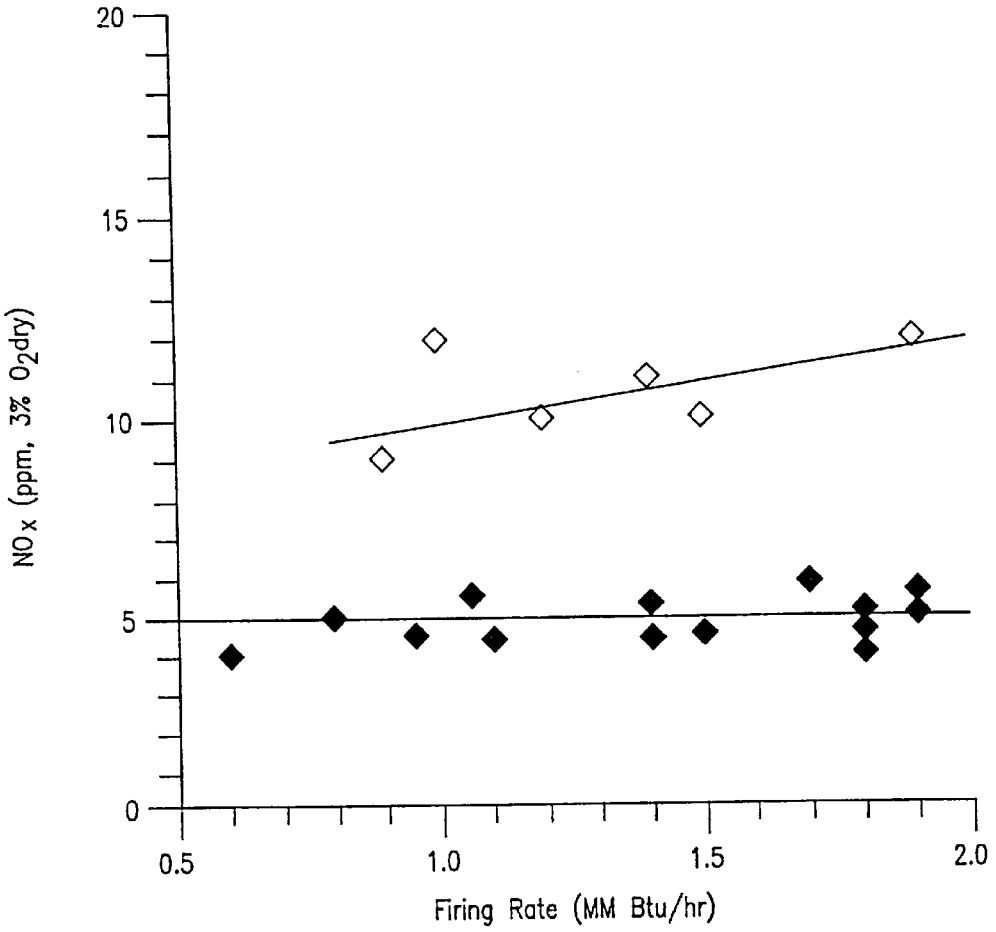
FIG. 8 is a plot of measured $NO_x$ emissions for a prototype burner/pilot system according to the principles of the present invention.

FIG. 8 shows measured $NO_x$ emissions for two configurations of burner, incorporating the principles of the present invention, when firing natural gas. The two configurations involve varying the number of secondary fuel injectors at particular specified angles relative to the vertical. The $NO_x$ emissions are shown as a function of burner firing rate. For all conditions, the measured CO emissions were extremely low (less than 2 ppmV). The dependence of $NO_x$ emissions on the angle of the secondary fuel injectors to the axial direction is illustrated. An optimum configuration of six secondary injectors at 18% yields $NO_x$ emissions of approximately 5 ppmV.

Figure 9:
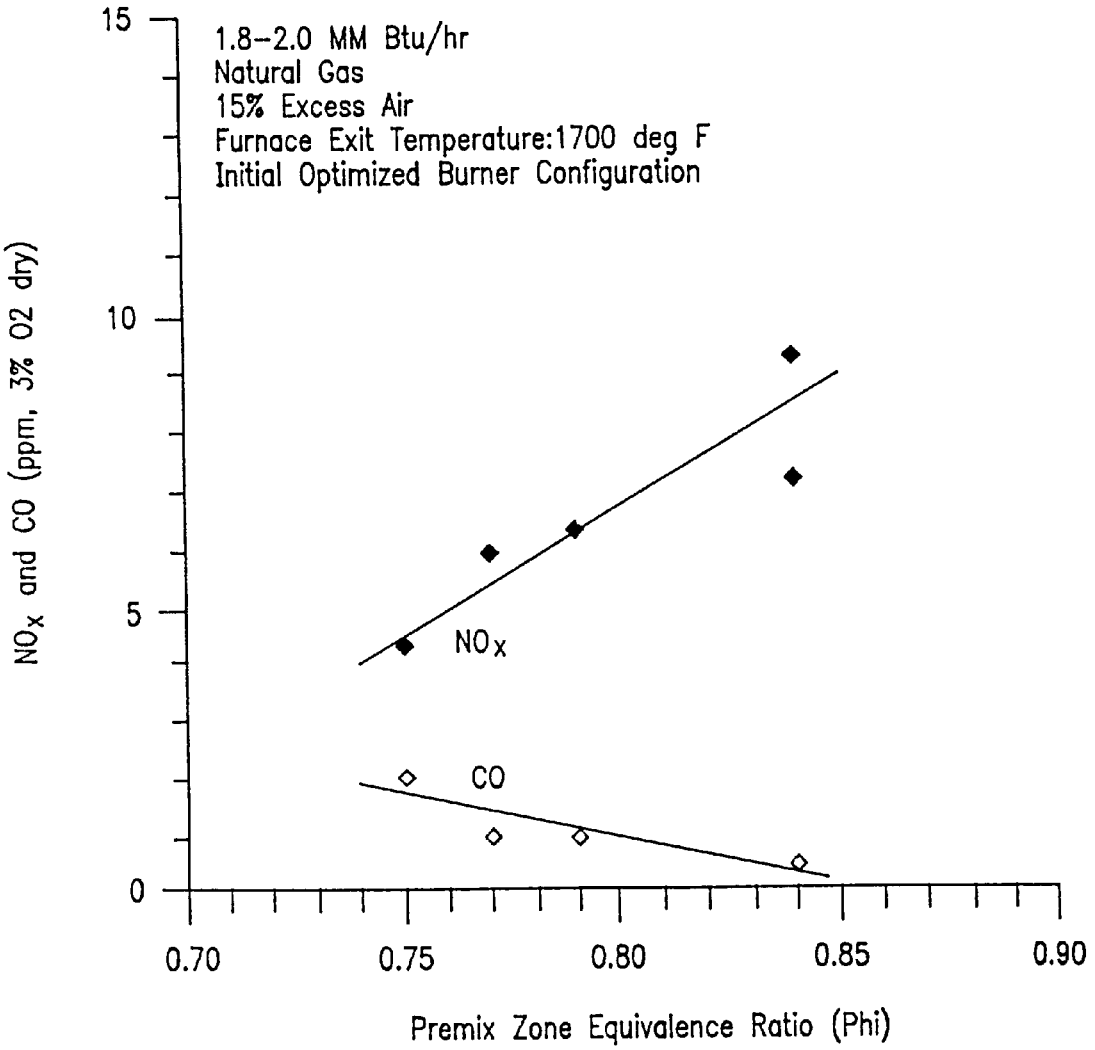
FIG. 9 is a plot illustrating the dependence of $NO_x$ and CO emissions on the premix region equivalence ratio, of a burner in accordance with the present invention.

FIG. 9 shows the dependence of $NO_x$ and CO emissions on the premix region equivalence ratio, indicating the importance of lean conditions in that part of the flame for achieving the lowest possible $NO_x$ emissions.

Figure 10:
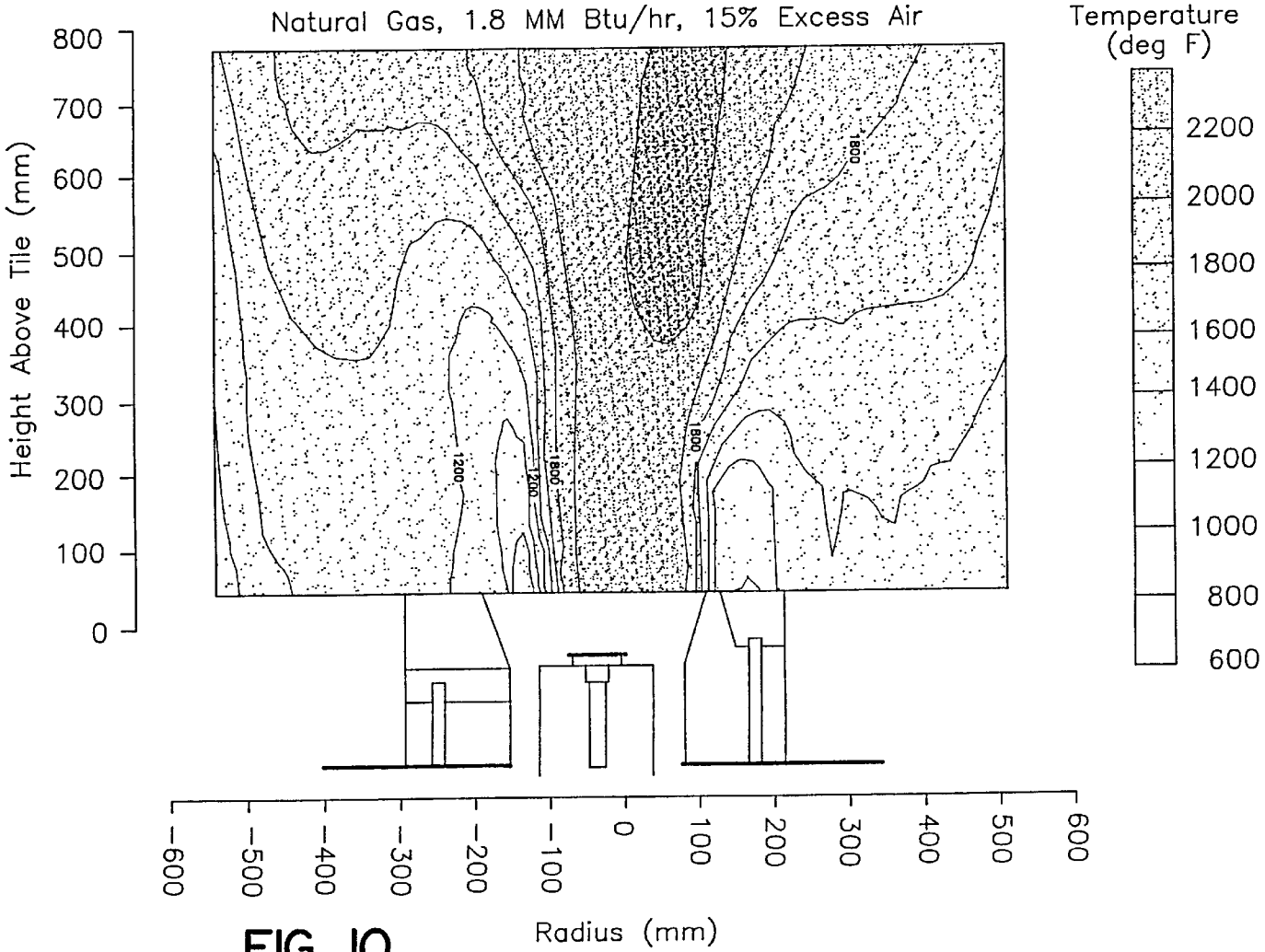
FIG. 10 is a flame temperature map for a "full-fire" condition, for a burner in accordance with the present invention.

FIG. 10 shows a temperature contour map of the flame. Peak flame temperatures are less than 2300° F., much lower than the level at which formation of thermal $NO_x$ is of concern (approximately 2800° F.). Low flame temperatures (caused by extensive recirculation of flue gas into the flame) are responsible for the overall very low emissions.

Figure 11:
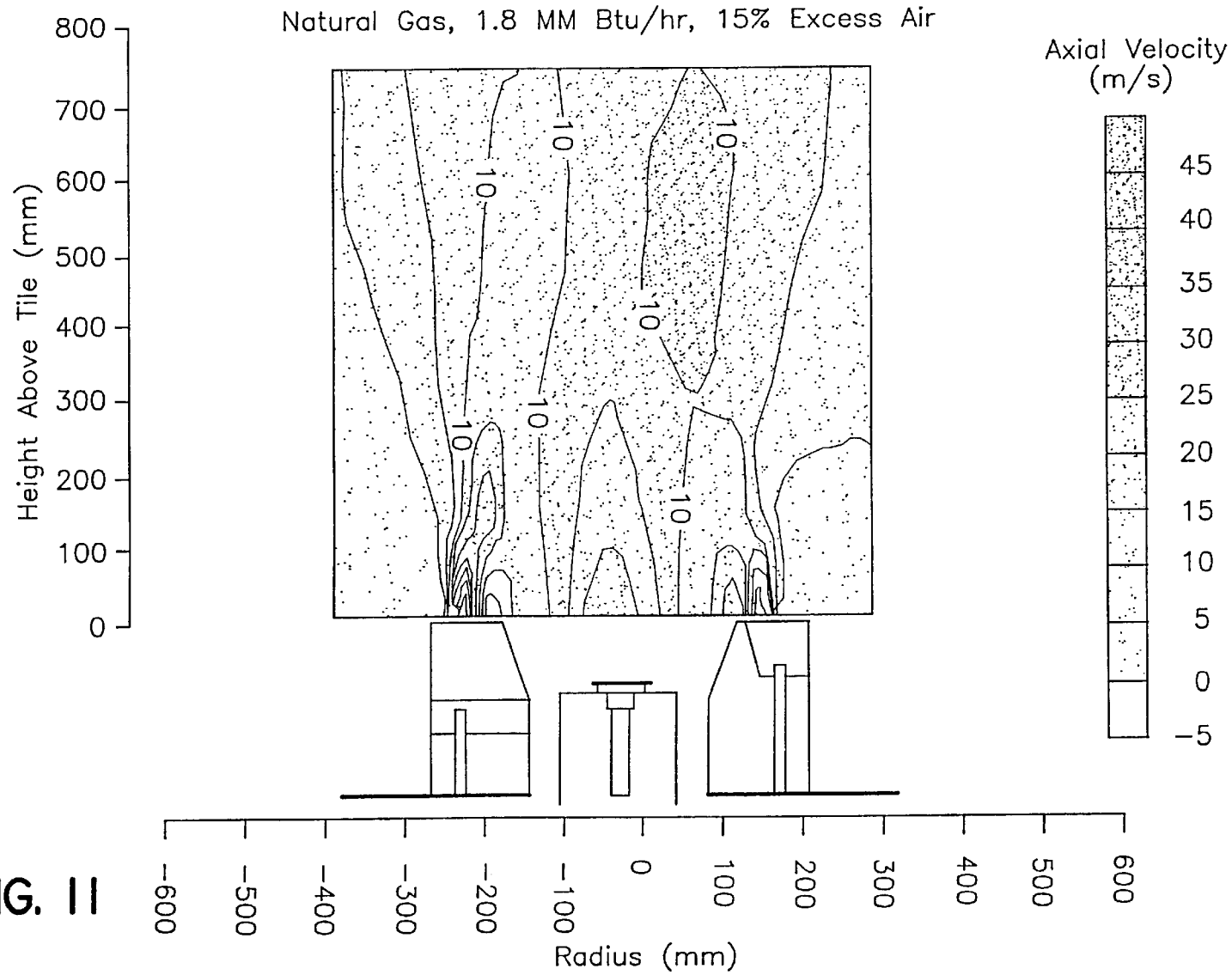
FIG. 11 is an axial velocity map for a "full-fire" condition, for a burner in accordance with the present invention.

FIG. 11 shows an axial velocity contour map for the flame. The large recirculation region downstream of pilot flame holder 22 is indicated by the extent of the negative axial velocity region. This large recirculation region, in combination with the low emissions surface combustion pilot, enables a highly stable flame to be maintained at these low temperature, ultra-low-emissions conditions.

The performance of a furnace/heater having a burner/pilot configuration, such as illustrated herein, in accordance with the principles of the present invention, may be adjusted in a number of ways. For example, the primary fuel/furnace gas swirl and stoichiometry distribution can be adjusted by employing a burner quarl having passages 32 oriented at different angles to the radial. Swirl vanes can be installed at the exit of the premix venturi tube 18 to impart swirl to either the premix core flow or to the annular air flow (as illustrated). A damper can be installed and adjusted to control air entrainment into the premix venturi tube. The entire premix venturi tube assembly may be adjusted vertically to control air flow splits. The entire pilot assembly may be adjusted vertically to change the location of the flame within the burner quarl.

A furnace equipped with a burner such as disclosed in FIGS. 1 and 2, with the appropriate instrumentation and controls, would have the potential to enjoy numerous ancillary benefits in operation such as: 1) achievement of higher furnace throughput by modification of flame shape to both optimize the heat flux profile and improve the balance of heat transfer to individual passes; 2) detection of coking; 3) altering of the heat flux profile to maximize furnace availability and productivity after the onset and build up of coking and; 4) predictive emissions monitoring.

Further, the total system of burner, together with surface combustion flame holder/pilot are believed to have several advantages over prior art burners, including: a) much lower emissions; b) practical designs which can meet substantially all potential user requirements; c) the system is retrofittable into many if not most existing furnaces and process heaters;

d) no external (to the furnace) flue gas recirculation is required; and e) no special treatment of the gaseous fuel is required to obtain optimal furnace performance.

The invention is discussed hereinabove, in the environment of a radially symmetrical, cylindrical burner, having a single premixed fuel injector, such as may be appropriate for smaller scale heater applications. The principles of the present invention is not limited to the embodiments of FIGS. 1–11, and may be applied to non-cylindrical burners, and burners for larger scale operations. For example, FIGS. 12 and 13 illustrate a potential configuration for a burner having a rectangular plan.

Figure 12:
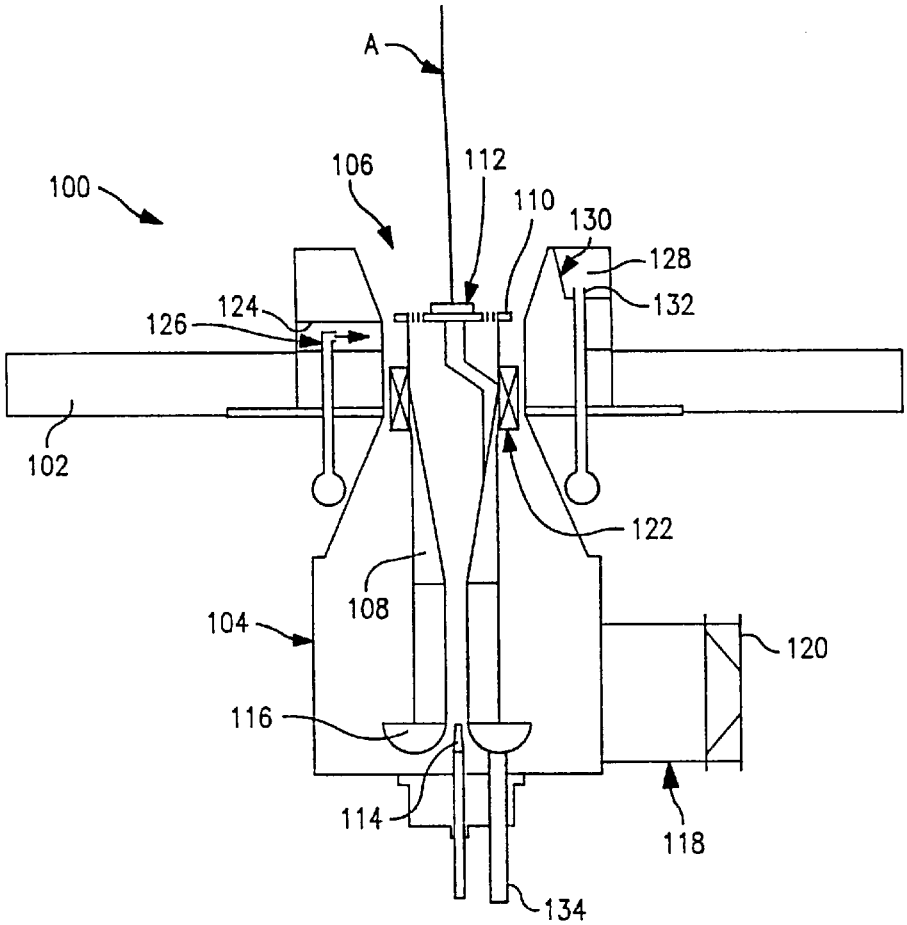
FIG. 12 is a schematic illustration, in section, of the variable heat flux low emissions burner, in accordance with an alternative embodiment of the present invention.
Figure 13:
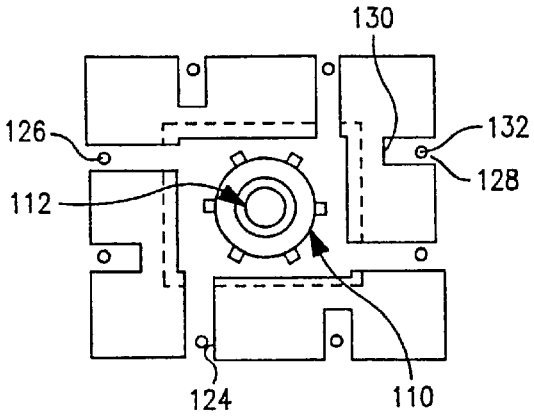
FIG. 13 is a top plan view of the burner quarl and flame holder/pilot for the burner of FIG. 12.

FIGS. 12 and 13 illustrate schematically an alternative possible configuration of a variable heat flux low emissions burner according to the invention. The burner is generally rectangular, and has an axis A and includes a burner quarl 100 (also "burner block") which is fixably mounted into a furnace wall, floor or roof 102 (hereinafter "floor" for simplicity). A burner housing 104 is situated external to the furnace wall, floor or roof, floor or roof. The burner quarl 100 is a substantially rectangular structure having an axially extending bore 106. A venturi tube 108 extends from the burner housing into bore 106 and is capped by flame holder 110, which includes pilot 112.

Fuel tip 114 projects into inlet 116 of venturi tube 108 for enabling injection of gaseous fuel. Air duct 118 connects to burner housing 104 for permitting the introduction of combustion air into burner housing 104. A portion of the air inletted from duct 118 is entrained in the fuel gas jet from fuel tip 114, and the remaining air inletted from duct 118 surrounds venturi tube 108 and flows upwardly. The combustion air flow through duct 118 is induced into the burner by the thermal draft generated within the furnace (or by the provision of a blower or induction fan in the exhaust). The air flow is regulated by damper 120.

Inside the burner housing 104, the air flow is divided into two streams: the premix air passes through venturi tube 108, while the secondary air passes through an annulus around venturi tube 108. The proportional split of the air flow is determined by the geometry and size of the venturi tube 108 and annulus and the height of the venturi tube inlet above the burner housing floor. The proportion of the total air that flows through the venturi tube and the proportion of the total fuel that flows through the venturi tube are adjusted so as to generate a combustible, lean fuelair mixture at the exit of the venturi tube. In a preferred configuration, approximately 15–20% by volume of the total air flow passes through the venturi. Vanes 122 may be provided to support venturi tube 108 and keep it centered in bore 106. In addition, vanes 122 may be pitched at an angle, to impart a swirling motion to the rising combustion air.

Burner quarl 100 is provided with a plurality of substantially horizontally extending passages 124 which extend from an exterior surface of burner quarl 100 completely through to bore 106. Preferably, each passage 124 is oriented relative to the axis of burner quarl 100 so that the direction of flow which would be enabled through each passage 124 is substantially tangential to flame holder 110 upon entry into bore 106. Alternatively, passages 124 may be arranged to be radial to axis A. A primary fuel tip 126 is positioned inside each passage 124 and is connected to a source of gaseous fuel.

A plurality of notches 128 are provided in the upper, outer surface of burner quarl 100. Each notch 128 extends from a position on the outer surface of burner quarl 100 to a position within burner quarl 100, but not extending completely to bore 106. The inner face 130 of each notch 128 is preferably angled radially inward and upward for facilitating the directing of flow radially inward from the notch. A secondary fuel tip 132 is provided in each notch 128 and is likewise connected to a source of gaseous fuel.

A separate pilot gas/air tube 134 extends upward partially within the wall of venturi tube 108 up to the underside of flame holder 110 to provide fuel gas and combustion air for pilot 112.

The secondary fuel tips 132 are positioned and angled in a manner similar to that of the secondary fuel tips in the embodiment of FIGS. 1 and 2, and the method and operation of the burner and pilot of FIGS. 12 and 13 is substantially the same as well, with such minor variations as may be necessary due to the rectangular shape of burner quarl 100 being readily apparent to one of ordinary skill in the art having the present disclosure before them.

The principles of the present invention can also be applied to non-symmetrical burner quarl configurations.

Figure 14:
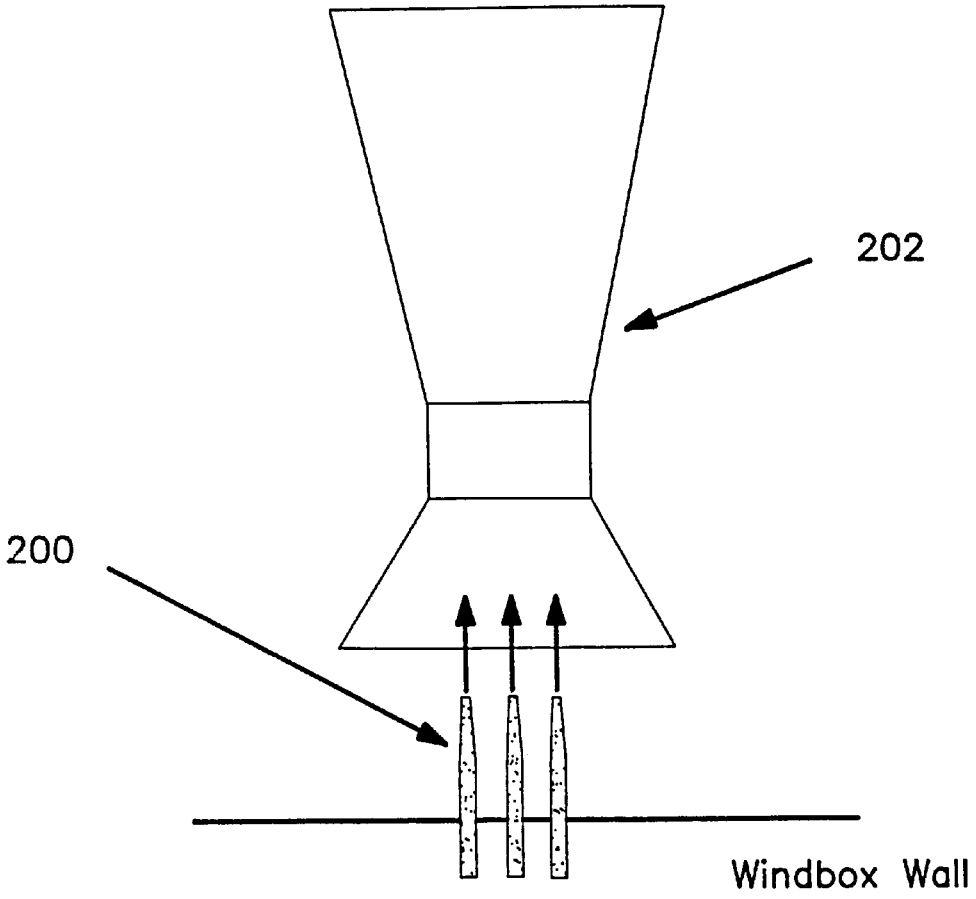
FIG. 14 is a schematic illustration of a burner venturi arrangement having plural premix injectors.
Figure 15:
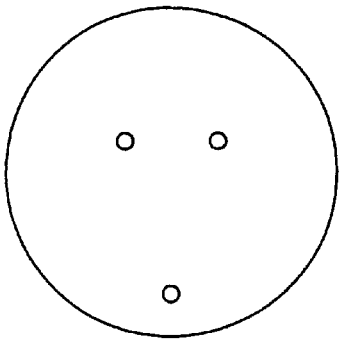
FIG. 15 is a top view of the schematic illustration of FIG. 14.

The previous embodiments have been illustrated as examples typically for relatively small scale heaters and furnaces. In the event that a burner/pilot construction according to the present invention is to be used for a large scale heater or burner, than a plurality of premix fuel/air injectors may be provided. This is illustrated schematically in FIGS. 14 and 15, in which three premix injectors 200 may be provided to supply fuel and air into venturi 202. A greater or lesser number of premix injectors may be used, as the size/scale requirements of the particular application dictate.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. A burner apparatus for burning gaseous fuel, of the type configured for use in industrial heaters, furnaces, and boilers, comprising:

a burner quarl, disposed in a wall, floor or roof of an enclosure, the interior space of which is to be heated, the burner quarl having an axis and a bore therethrough;

means for supplying a stream of mixed air and gaseous fuel through the bore of the burner quarl, substantially parallel to the axis of the burner quarl;

means for supplying a stream of combustion air, substantially unmixed with gaseous fuel, into the bore of the burner quarl;

means for supplying a first stream of gaseous fuel into the bore of the burner quarl;

means for supplying a second stream of gaseous fuel into a combustion region disposed downstream of the burner quarl; and means for selectively varying the means for supplying a stream of mixed air and gaseous fuel, the means for supplying a first stream of gaseous fuel, and the means for supplying a second stream of gaseous fuel during operation of the burner apparatus to, in turn, vary the relative proportions of gaseous fuel being supplied to the means for supplying a stream of mixed air and gaseous fuel, the means for supplying a first stream of gaseous fuel, and the means for supplying a second stream of gaseous fuel to be selectively varied during the operation of the burner apparatus, in order to vary the pattern of heat flux being produced when the burner apparatus is in operation.

2. The burner apparatus according to claim 1, further comprising:

means for directing flue gases in the enclosure into the bore of the burner quarl.

3. The burner apparatus according to claim 2, wherein the means for directing flue gases further comprise:

at least one passage in the burner quarl, extending from an exterior surface of the burner quarl to the bore of the burner quarl.

4. The burner apparatus according to claim 3, wherein the means for supplying a first stream of gaseous fuel into the bore of the burner quarl further comprises:

at least one fuel nozzle disposed in the at least one passage, and connected to a source of gaseous fuel.

5. The burner apparatus according to claim 1, wherein the means for supplying a second stream of gaseous fuel into a combustion region disposed downstream of the burner quarl further comprises:

at least one fuel nozzle disposed at a position on the periphery of the burner quarl, the at least one fuel nozzle being disposed to aim a jet of fuel gas toward the axis of the burner quarl, at a position downstream from the burner quarl.

6. The burner apparatus according to claim 1, wherein the means for supplying a stream of mixed air and gaseous fuel through the bore of the burner quarl further comprises:

a tube, having a first end extending into the bore of the burner quarl, and having a second end disposed at a position remote from the bore of the burner quarl;

a source of gaseous fuel, disposed to inject a stream of gaseous fuel into the second end of the tube;

a source of combustion air, operably associated with the tube, for enabling combustion air to be entrained into the stream of gaseous fuel being injected into the second end of the tube.

7. The burner apparatus according to claim 6, wherein the means for supplying a stream of combustion air, substantially unmixed with gaseous fuel, into the bore of the burner quarl, further comprises:

a burner housing, associated with the burner quarl and positioned substantially exterior to the wall, floor or roof of the enclosure, and opening onto the bore of the burner housing, the burner housing substantially surrounding the second end of the tube, and operably associated with the source of combustion air, for enabling at least a portion of combustion air to pass along an outside surface of the tube, from the second end of the tube to the first end of the tube and into the bore of the burner quarl.

8. A method for operating a burner apparatus for burning gaseous fuel, of the type configured for use in industrial heaters, furnaces, and boilers, comprising:

disposing a burner quarl in a wall, floor or roof of an enclosure, the interior space of which is to be heated, the burner quarl having an axis and a bore therethrough;

supplying a stream of mixed air and gaseous fuel through the bore of the burner quarl, substantially parallel to the axis of the burner quarl;

supplying a stream of combustion air, substantially unmixed with gaseous fuel, into the bore of the burner quarl;

supplying a first stream of gaseous fuel into the bore of the burner quarl;

supplying a second stream of gaseous fuel into a combustion region disposed downstream of the burner quarl, selectively varying the means for supplying a stream of mixed air and gaseous fuel, the means for supplying a first stream of gaseous fuel, and the means for supplying a second stream of gaseous fuel during operation of the burner apparatus to, in turn, vary the relative proportions of gaseous fuel being supplied to the means for supplying a stream of mixed air and gaseous fuel, the means for supplying a first stream of gaseous fuel, and the means for supplying a second stream of gaseous fuel to be selectively varied during operation of the burner apparatus, in order to vary the pattern of heat flux being produced when the burner apparatus is in operation.

9. The method for operating a burner apparatus according to claim 8, further comprising:

directing flue gases in the enclosure into the bore of the burner quarl.

10. The method for operating a burner apparatus according to claim 9, wherein the step of directing flue gases further comprises:

extending at least one passage in the burner quarl, from an exterior surface of the burner quarl to the bore of the burner quarl.

11. The burner apparatus according to claim 10, wherein the step of supplying a first stream of gaseous fuel into the bore of the burner quarl further comprises:

disposing at least one fuel nozzle in the at least one passage, and connecting it to a source of gaseous fuel.

12. The method for operating a burner apparatus according to claim 8, wherein the step of supplying a second stream of gaseous fuel into a combustion region disposed downstream of the burner quarl further comprises:

disposing at least one fuel nozzle at a position on the periphery of the burner quarl, to aim a jet of fuel gas toward the axis of the burner quarl, at a position downstream from the burner quarl.

13. The method for operating a burner apparatus according to claim 8, wherein the step of supplying a stream of mixed air and gaseous fuel through the bore of the burner quarl further comprises:

extending a first end of a tube into the bore of the burner quarl, and disposing a second end of the tube at a position remote from the bore of the burner quarl;

disposing a source of gaseous fuel, to inject a stream of gaseous fuel into the second end of the tube;

operably associating a source of combustion air, with the tube, for enabling combustion air to be entrained into the stream of gaseous fuel being injected into the second end of the tube.

14. The method for operating a burner apparatus according to claim 13, wherein the step of supplying a stream of combustion air, substantially unmixed with gaseous fuel, into the bore of the burner quarl, further comprises:

associating a burner housing, with the burner quarl and positioning it substantially exterior to the wall, floor or roof of the enclosure, and opening onto the bore of the burner housing, substantially surrounding the second end of the tube with the burner housing, and operably associating it with the source of combustion air, for enabling at least a portion of combustion air to pass along an outside surface of the tube, from the second end of the tube to the first end of the tube and into the bore of the burner quarl.

* * * * *